US007178908B2

(12) United States Patent
Katayama

(10) Patent No.: US 7,178,908 B2
(45) Date of Patent: Feb. 20, 2007

(54) BUFFER TANK FOR INK JET PRINTER

(75) Inventor: Naoki Katayama, Kariya (JP)

(73) Assignee: Brother Kogyo Kabushiki Kaisha, Nagoya (JP)

( * ) Notice: Subject to any disclaimer, the term of this patent is extended or adjusted under 35 U.S.C. 154(b) by 245 days.

(21) Appl. No.: 10/926,867

(22) Filed: Aug. 26, 2004

(65) Prior Publication Data

US 2005/0068388 A1 Mar. 31, 2005

(30) Foreign Application Priority Data

Sep. 26, 2003 (JP) ..... 2003-336044
Sep. 26, 2003 (JP) ..... 2003-336045

(51) Int. Cl.
*B41J 2/175* (2006.01)

(52) U.S. Cl. ..... 347/85

(58) Field of Classification Search ..... 347/85, 347/86, 87; 141/2, 18
See application file for complete search history.

(56) References Cited

U.S. PATENT DOCUMENTS 4,419,678 A * 12/1983 Kasugayama et al. ..... 347/86
5,905,518 A * 5/1999 DeFilippis ..... 347/85
6,022,102 A * 2/2000 Ikkatai et al. ..... 347/85
6,234,615 B1 * 5/2001 Tsukuda ..... 347/85
6,520,630 B1 * 2/2003 Oda et al. ..... 347/85
6,561,637 B2 5/2003 Hino
6,702,427 B2 3/2004 Shimizu et al.
6,702,433 B2 * 3/2004 Kono ..... 347/85
6,802,601 B2 * 10/2004 Suzuki et al. ..... 347/86

FOREIGN PATENT DOCUMENTS

EP 1 232 871 8/2002
EP 1 273 451 A2 1/2003
JP 2002307711 10/2002

OTHER PUBLICATIONS

Copy EP Search Report.

* cited by examiner

*Primary Examiner*—Anh T. N. Vo
(74) *Attorney, Agent, or Firm*—Day Pitney LLP

(57) ABSTRACT

There is disclosed a buffer tank for an ink jet printer, comprising: a main body having a top plate; an air intake through which outside air is taken into the tank; an air outlet passage comprising at least a part extending in the main body downward from the top plate, to flow the air in the tank out into an ink cartridge; and an ink inlet passage comprising at least a part extending in the main body downward from the top plate, to draw the ink in the cartridge into the tank. Each of the air outlet and ink inlet passages comprises a hollow needle disposed at the top plate and vertically extends, and at least one of the air outlet and ink inlet passages comprises a hollow tubular member extending downward from the top plate, whose inner space is in communication with an inner space of the corresponding needle.

20 Claims, 7 Drawing Sheets

RELATED ART

RELATED ART

BUFFER TANK FOR INK JET PRINTER

The present application is based on Japanese Patent Application Nos. 2003-336044 and 2003-336045, filed on Sep. 26, 2003, the content of which is incorporated herein by reference.

BACKGROUND OF THE INVENTION

1. Field of the Invention

The present invention generally relates to an ink jet printer capable of regulating a back pressure of an ink acting on a nozzle at a substantially constant value, and also to a buffer tank for such a regulation of the back pressure.

2. Discussion of Related Art

In the ink jet printer for performing a printing by ejecting an ink from a nozzle onto a recording medium, a variation in a back pressure of the ink acting on the nozzle, which may be caused by a variation in an amount of the ink in an ink cartridge, adversely affects an accuracy in the ink ejection from the nozzle. Hence, it is typical that an ink jet printer is equipped with a mechanism for suppressing the variation in the back pressure of the ink.

An example of such an ink jet printer (as disclosed in U.S. Pat. No. 6,702,427, for instance) is equipped with a buffer tank in which is held an ink whose surface is maintained substantially at a constant level, to suppress the variation in the back pressure acting on the nozzle. This buffer tank is shown in FIGS. 7 and 8 and denoted by reference numeral 100. The buffer tank 100 has a top plate 104, and an ink inlet needle or hollow needle 102 for drawing an ink I in an ink cartridge 101 into the buffer tank 100, and an air outlet needle or hollow needle 103 for flowing the air out into the ink cartridge 101; the ink inlet and air outlet hollow needles 102, 103 are disposed to extend through the top plate 104. In the buffer tank 100, the ink inlet hollow needle 102 extends downward farther than the air outlet hollow needle 103, near a bottom of the buffer tank 100. In this regard, since each of the hollow needles 102, 103 extends through one of two plug members 106 provided to the ink cartridge 101 when the ink cartridge 101 is attached to the buffer tank 100, each of the hollow needles 102, 103 is formed in a hollow needle-like shape.

In a state where the ink I is not ejected from the nozzle, as shown in FIG. 7, the ink I does not flow out of the buffer tank 100 toward the nozzle, and the ink level is held still at a level close to the lower end of the air outlet hollow needle 103 with the ink I present inside a lower end part of the air outlet hollow needle 103. That is, in this state, because the air is not allowed to flow out into the ink cartridge 101 via the air outlet hollow needle 103, the ink I in the ink cartridge 101 is not drawn into the buffer tank 100. When the ink I is ejected from the nozzle in this state, the ink I flows out of the buffer tank through an ink outlet 105 formed in a bottom portion of the buffer tank 100 toward the nozzle, with the ink level of the buffer tank 100 lowered.

Then, the ink surface is separated from the lower end of the air outlet hollow needle 103, with a meniscus being formed around or inside the lower end of the air outlet hollow needle 103. When the ink surface is further lowered and a head difference reaches a certain value $h_o$, the formed meniscus is broken, with the air in the buffer tank 100 flowing out into the ink cartridge 101 through the air outlet hollow needle 103. Then, the ink I in the ink cartridge 101 is drawn into the buffer tank 100 through the ink inlet hollow needle 102 in place of the air. The ink level of the buffer tank 100 accordingly arises and eventually virtually reaches the lower end of the air outlet hollow needle 103. The state where the air in the buffer tank 100 is not allowed to flow out into the ink cartridge 101 is again established, with the flow of the ink I into the buffer tank 100 stopped.

In the buffer tank shown in FIGS. 7 and 8, however, a meniscus is formed around or inside the air outlet hollow needle, when the ink level is lowered. When the ink level has been lowered to the level to make the head difference $h_0$ (a distance between the lower end of the air outlet hollow needle and the ink surface), the meniscus is broken at last, allowing the ink to flow into the buffer tank. That is, the ink level of the buffer tank varies by the head difference $h_o$. Since the air outlet hollow needle is formed of a narrow, hollow needle-like member, it is inevitable that the head difference $h_0$ between the lower end of the air outlet hollow needle and the ink surface which is necessary to break the meniscus is relatively large. Accordingly, the variation in the ink level of the buffer tank is relatively large, making it difficult to hold the back pressure of the ink acting on the nozzle substantially constant. Further, depending on a head difference $h_0$ necessary to break a meniscus, there may be a case where the meniscus formed at the outer periphery of the air outlet hollow needle can not be broken. In this case, the ink supplied to the nozzle may include undesirable air bubbles.

In addition, in the buffer tank as shown in FIGS. 7 and 8, the ink in the ink cartridge flows out or is drawn into the buffer tank via the ink inlet hollow needle which is narrow and extends down to a level near the bottom of the buffer tank. Therefore, the resistance to the flow of the ink flowing into the buffer tank is relatively large. Thus, when the ink level of the buffer tank is lowered upon ejection of the ink from the nozzle which involves the supply of the ink out of the buffer tank, the replenishing the buffer tank with the ink is impeded.

Particularly where the temperature is low or where the viscosity of the ink is relatively high due to evaporation of water in the ink or others, the resistance to the ink flow is further increased, slowing the replenishing the buffer tank with the ink. When the ink level is lowered in such a case, the ink level can not be immediately restored to the original level (close to the lower end of the air outlet hollow needle), leading to deterioration in the constancy of the ink level which in turn adversely affects the constancy of the back pressure of the ink acting on the nozzle. Further, there may be a case where the ink is not drawn into the buffer tank even when the ink level has been lowered near the bottom of the buffer tank; in this case, the ink supplied to the nozzle may include air bubbles.

SUMMARY OF THE INVENTION

In view of the above-described situations, an object of the present invention is to provide a buffer tank which enables to immediately flow the air out into an ink cartridge and thereby to immediately replenish the buffer tank with an ink when an ink level of the buffer tank is lowered, so that the variation in the ink level of the buffer tank is suppressed to the maximum extent possible.

To attain the object, the invention provides a buffer tank for an ink jet printer, on whose upper side is attached an ink cartridge containing an ink which is drawn into the buffer tank, and which comprises: a main body having a top plate; an air intake through which air outside the buffer tank is taken into the tank; an air outlet passage comprising at least a part extending in the main body downward from the top plate, so as to flow the air in the tank out into the cartridge;

and an ink inlet passage comprising at least a part extending in the main body downward from the top plate, so as to draw the ink in the cartridge into the tank. Each of the air outlet and ink inlet passages comprises a hollow needle disposed at the top plate and vertically extends, and at least one of the air outlet and ink inlet passages further comprises a hollow tubular member which extends downward from the top plate and whose inner space is in communication with an inner space of the corresponding hollow needle.

When printing is performed by a device including the buffer tank and a nozzle, the air is taken into the buffer tank as a result of supply of the ink from the buffer tank to the nozzle to perform a printing, and is then introduced into the ink cartridge. Thus the ink in the ink cartridge is drawn into the buffer tank in place of the air which has flown out into the ink cartridge.

In the above buffer tank, where the air outlet passage comprises the tubular member, the tubular member is configured such that the tubular member extends down from the top plate to a level below a lower end of the hollow needle of the air outlet passage and above a lower end of the ink inlet passage, with a cross-sectional area of a hollow of the tubular member at least at a lower end thereof being larger than a cross-sectional area of a hollow of the hollow needle of the air outlet passage.

In the state where the air is not taken into the buffer tank, that is, when there is no ink supply from the buffer tank to the nozzle, a surface of the ink in the buffer tank (which will be hereinafter referred to as "the ink surface") is held still at a level near the lower end of the tubular member which end is located below the lower end of the hollow needle, such that the ink is present inside the tubular member to preclude the air from being introduced into the ink cartridge through the air outlet passage. When the ink in the buffer tank flows out of the buffer tank toward the nozzle in this state, the level of the ink in the buffer tank (which will be referred to as "the ink level of the buffer tank" hereinafter) is lowered, separating the ink surface from the lower end of the tubular member. At this moment, a meniscus is formed around or inside the lower end of the tubular member by the surface tension of the ink. In the state where the meniscus is thus formed, it is impossible to flow out the air through the air outlet passage into the ink cartridge. However, according to the present invention where the cross-sectional area of the hollow of the tubular member, at least at the lower end thereof, is larger than that of the air outlet hollow needle, the meniscus is more easily broken by the lowering of the ink level, in other words, the meniscus is broken by a smaller lowering of the ink level, than in the arrangement where the meniscus is formed directly around or inside the air outlet hollow needle.

Thus, a slight lowering of the ink surface off the lower end of the tubular member breaks the meniscus, allowing the air to be introduced into the ink cartridge through the air outlet passage. That is, when the ink level of the buffer tank is lowered, the buffer tank is immediately replenished with the ink drawn from the ink cartridge, enabling to suppress the variation in the ink level which in turn enables to effectively suppress the variation in the back pressure acting on the nozzle.

The buffer tank may be arranged such that the hollow needle vertically extends through the top plate, and a part of the hollow needle extending below the top plate, in the main body of the buffer tank, is inserted in the tubular member.

In this arrangement, the air in the buffer tank is introduced from the lower end of the tubular member and, in the buffer tank, flows through the hollow needle inserted in the tubular member, to be eventually drawn into the ink cartridge.

Meanwhile, where the ink inlet passage comprises the tubular member, the tubular member is configured such that the tubular member extends down from the top plate to a level below a lower end of the hollow needle of the ink inlet passage and a lower end of the air outlet passage, with a cross-sectional area of a hollow of the tubular member being larger than a cross-sectional area of a hollow of the hollow needle of the ink inlet passage.

In the state where there is no ink supply from the buffer tank to the nozzle, the ink surface is held still at a level near the lower end of the tubular member of the air outlet passage, such that the air is precluded from being introduced into the ink cartridge through the air outlet passage. When the ink in the buffer tank flows out of the buffer tank toward the nozzle in this state, the air in the buffer tank is introduced into the ink cartridge, and the ink in the ink cartridge is drawn, in place of the air which has flown out into the ink cartridge, into the buffer tank through the ink inlet passage. At this moment, because the ink flows through the tubular member whose hollow has a cross-sectional area larger than a cross-sectional area of the hollow of the hollow needle, the resistance to the ink flow is reduced, enabling immediate replenishment of the buffer tank with the ink. The variation in the ink level of the buffer tank is thus suppressed to the maximum extent possible, so as to suppress the variation in the pressure of the ink acting on the back side of the nozzle.

The buffer tank may be arranged such that the hollow needle vertically extend through the top plate, and a part of the hollow needle extending below the top plate, in the main body of the buffer tank, is inserted in the tubular member.

In this arrangement, the ink in the ink cartridge is drawn into the buffer tank through the hollow needle of the ink inlet passage, and, in the buffer tank, flows through the tubular member having a cross-sectional area larger than a cross-sectional area of the hollow needle, where the resistance to the ink flow is reduced.

In a specific mode of the buffer tank, each of the air outlet passage and the ink inlet passage comprises the tubular member, such that: the tubular member of the air outlet passage extends down to a level below a lower end of the hollow needle of the air outlet passage, with a cross-sectional area of a hollow of the tubular member at least at a lower end thereof being larger than a cross-sectional area of a hollow of the hollow needle of the air outlet passage; the tubular member of the ink inlet passage extends down to a level below a lower end of the hollow needle of the ink inlet passage, with a cross-sectional area of a hollow the tubular member being larger than a cross-sectional area of a hollow of the hollow needle of the ink inlet passage; and the lower end of the tubular member of the air outlet passage is located above a lower end of the tubular member of the ink inlet passage.

According to this mode, when the ink level of the buffer tank is lowered, the air in the buffer tank can be immediately introduced into the ink cartridge by the arrangement of the air outlet passage, and then the ink in the ink cartridge can be accordingly drawn into the buffer tank immediately, again. Thus, the above mode provides a multiplicative effect in eliminating the delay in replenishing the buffer tank with the ink when the ink in the buffer tank is supplied to the nozzle, and thereby suppresses the variation in the back pressure acting on the nozzle.

The present invention is also directed to a printer including the buffer tank described above. Such a printer can enjoy the advantages and effects given by the buffer tank.

BRIEF DESCRIPTION OF THE DRAWINGS

The above and other objects, features, advantages and technical and industrial significance of the present invention will be better understood by reading the following detailed description of preferred embodiments of the invention, when considered in connection with the accompanying drawings, in which.

DETAILED DESCRIPTION OF THE PREFERRED EMBODIMENTS

There will be described presently preferred embodiments of the invention, by reference to the accompanying drawings.

Figure 1:
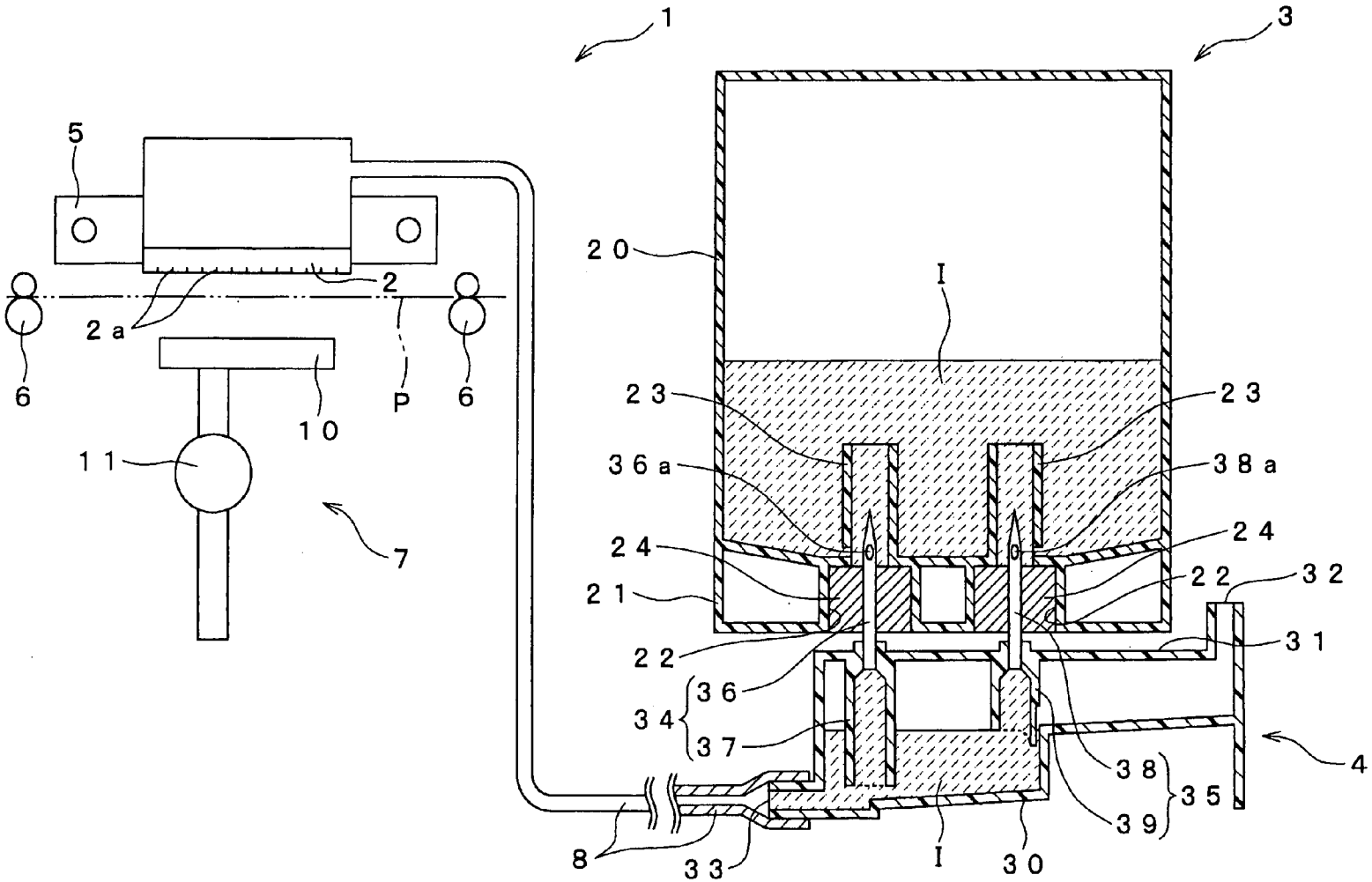
FIG. 1 is a schematic view of an ink jet printer according to a first embodiment of the invention.

Referring to FIG. 1, an ink jet printer 1 has an ink jet head 2 having nozzles 2*a* through which an ink I is ejected toward a recording sheet P, an ink cartridge 3 disposed on the upper side of a buffer tank 4 which is connected to the ink jet head 2 via an ink supply tube 8 and accommodates the liquid I flowing in from the ink cartridge 3, a carriage 5 for linearly reciprocating the ink jet head 2 in a direction, a feeding mechanism 6 for feeding the recording sheet P, and a purge device 7 for sucking in air in the ink jet head 2 and the ink I thickened there.

In the ink jet printer 1, the ink I is supplied from the buffer tank 4 to which the ink cartridge 3 is attached, via the ink supply tube 8, to the nozzles 2*a* of the ink jet head 2. To perform the printing on the recording sheet P, the ink jet head 2 is reciprocated by the carriage 5 perpendicularly to the feed direction of the recording sheet P while the recording sheet P is fed in the lateral direction in FIG. 1, in which state the ink I is ejected toward the recording sheet P through the nozzle(s) 2*a*. To prevent leakage of the ink I from the nozzles 2*a* while the ink I is not required to be discharged from the nozzles 2*a*, the nozzles 2*a* are disposed in a position above the liquid level of the ink I in the buffer tank 4.

The purge device 7 is movable in the directions toward and away from an ink ejecting surface of the ink jet head 2 and has a cap 10 attachable to the ink jet head 2 such that the cap covers the ink ejecting surface, and a suction pump 11 which suctions the ink I from the nozzles 2*a*. While the ink jet head 2 is out of its printing area (i.e. area where the printing operation is performed on the recording sheet P), it is possible to suck in the air introduced in the ink jet head 2 or the ink I (from which water has evaporated, making the viscosity high) through and from the nozzles 2*a* by the suction pump 11.

There will now be described the buffer tank 4, but only after brief illustration of the ink cartridge 3 disposed on the upper side of the buffer tank 4. As shown in FIG. 1, the ink cartridge 3 has a main body 20 of a synthetic resin for accommodating the ink I, and a cover part 21 made of a synthetic resin and covering the lower side of the main body 20. In the cover part 21 are formed two insert bores 22 into which an end part of each of an ink inlet hollow needle 36 and an air outlet hollow needle 38, which will be described later, is respectively inserted. The main body 20 of the ink cartridge 3 further has two cylindrical parts 23 continuously extending from the upper end of the respective insert bores 22 into the inside of the main body 20. In the insert bores 22 are press-fitted respective plug members 24 having a resilience for preventing leakage of the ink I. For instance, the plug members are made of a rubber.

Figure 2:
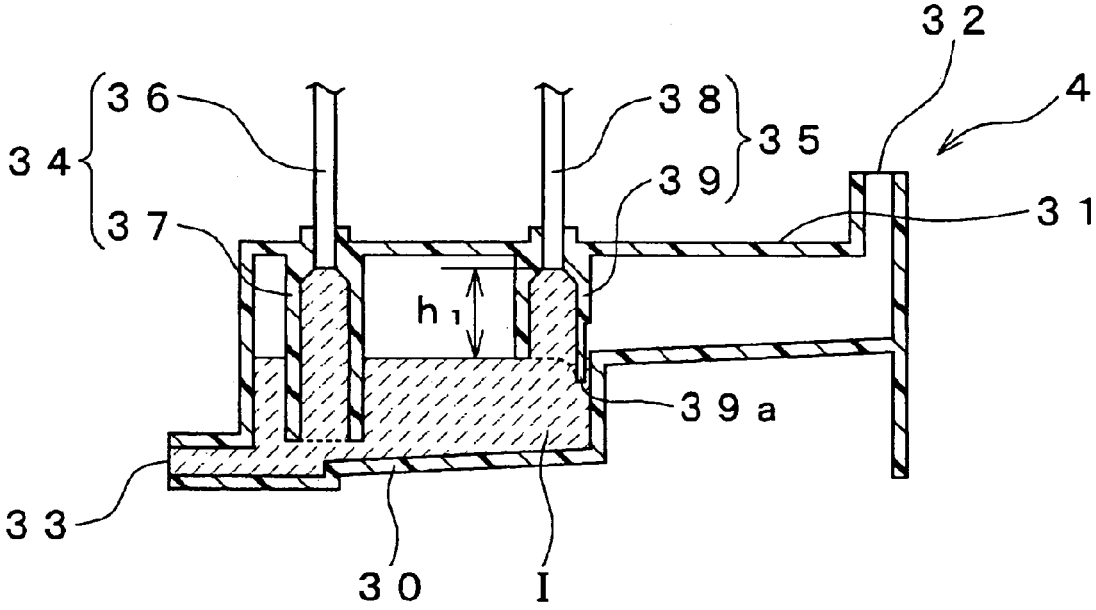
FIG. 2 is a cross sectional view of a buffer tank of the ink jet printer of FIG. 1.

The buffer tank 4 is for inhibiting variation in the back pressure acting on the ink I at the nozzles 2*a*, by holding constant the ink level of the buffer tank 4. As shown in FIGS. 1 and 2, the ink cartridge 3 is attached to the upper side of the buffer tank 4 so that the ink I in the ink cartridge 3 flows into the buffer tank 4. The buffer tank 4 has a main body 30 in which is accommodated the ink I and a top plate 31 covering the upper side of the main body 30. The main body 30 and the top plate 31 are respectively made of a synthetic resin. The buffer tank 4 has an air intake 32 through which the air is introduced into the buffer tank 4. In a bottom part of the main body 30 is formed an ink outlet 33, to which is connected the ink supply tube 8.

Further, the buffer tank 4 has an ink inlet passage 34 and an air outlet passage 35. The ink inlet passage 34 is for drawing the ink I in the ink cartridge 3 into the buffer tank 4, while the air outlet passage 35 is for discharging the air which is introduced through the air intake 32 into the buffer tank 4, into the ink cartridge 3.

The ink inlet passage 34 has an ink inlet hollow needle 36 which extends through the top plate 31, and a tubular member 37 (a second tubular member) which has a cylindrical shape having a diameter larger than that of the ink inlet hollow needle 36 and in which a part of the ink inlet hollow needle 36 which extends below the top plate 31 in the main body 30 is inserted. In this regard, an inner diameter of the ink inlet hollow needle 36 is preferably about 1.2–1.8 mm, while an inner diameter of the tubular member 37 is preferably two times, and more preferably three times, larger than the inner diameter of the ink inlet hollow needle 36. Further preferably, the inner diameter of the tubular member 37 is four times larger than the inner diameter of the ink inlet hollow needle 36. On the other hand, the air outlet passage 35 has an air outlet hollow needle 38 which extends through the top plate 31, and a tubular member 39 (a first tubular member) which has a cylindrical shape having a diameter larger than that of the air outlet hollow needle 38 and in which a part of the air outlet hollow needle 38 which extends below the top plate 31 in the main body 30 is inserted. In this regard, an inner diameter of the air outlet hollow needle 38 is preferably about 1.2–1.8 mm while an inner diameter of the tubular member 39 is preferably two times, and more preferably three times, larger than the inner diameter of the air outlet hollow needle 38. Further preferably, the inner diameter of the tubular member 39 is four times larger than the inner diameter of the air outlet hollow needle 38.

Each of the ink inlet hollow needle 36 and the air outlet hollow needle 38 is constituted by a hollow needle-like (or cylindrical) member with a pointed end which is made of a metal and has a relatively small diameter. The inner diameter of each hollow needle 36, 38 is, for instance, 1.4 mm. An upper end part of each hollow needle 36, 38 has an opening 36*a*, 38*a*. The ink inlet hollow needle 36 and air outlet hollow needle 38 are attached to the top plate 31 such that each of the hollow needles 36, 38 extends slightly below the top plate 31, and lower ends of the hollow needles 36, 38 are located substantially at the same level. Thus, the ink inlet hollow needle 36 and the air outlet hollow needle 38 can be constituted by an identical hollow needle-like member. In this regard, the conventional buffer tank using two sorts of such hollow needles having respective lengths for the air outlet passage and the ink inlet passage is relatively high in cost. According to the present invention, on the other hand, an identical member can be employed both as the ink inlet hollow needle 36 and the air outlet hollow needle 38, which reduces the required cost of the components of the buffer tank.

Figure 3:
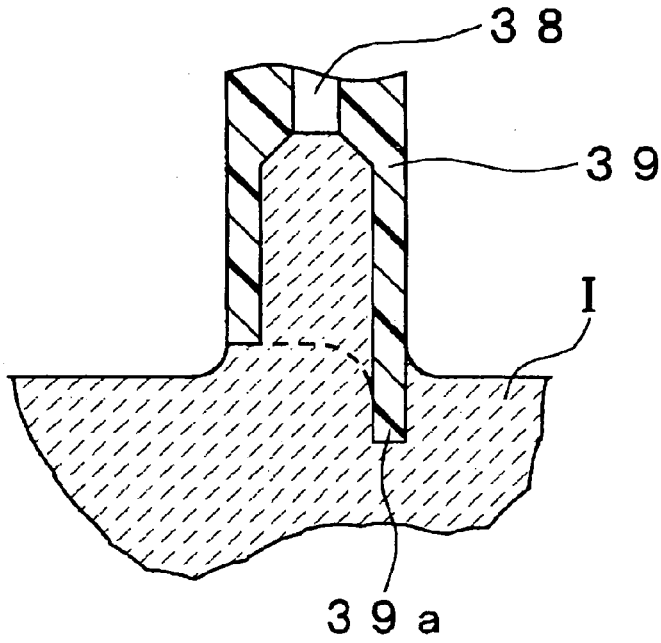
FIG. 3 is an enlarged view of a lower end portion of a tubular member of an air outlet passage of FIG. 2.

The two tubular members 37, 39 are formed integrally with the top plate 31 and made of a synthetic resin. The tubular member 39 is of circular section and has a diameter larger than that of the air outlet hollow needle 38 (e.g. about 6 mm in inner diameter). The cross-sectional area of a hollow of the tubular member 39 is larger than the cross-sectional area of a hollow of the air outlet hollow needle 38. The part of the air outlet hollow needle 38 which extends below the top plate 31 into the main body 30 is inserted in the tubular member 39 and thus the inside of the tubular member 39 is in communication with the air outlet hollow needle 38. The tubular member 39 extends downward farther than the air outlet hollow needle 38 does. As shown in FIGS. 1–3, a part of a circumference of a lower end of the tubular member 39 protrudes downward, forming a protrusion 39*a*. Accordingly, the distance between the lower end of the tubular member 39 at the part other than the protrusion 39*a* and the ink surface, and the distance between the protrusion 39*a* and the ink surface, are different.

On the other hand, the tubular member 37 is of circular section and has a diameter larger than that of the ink inlet hollow needle 36 (e.g. 6 mm in inner diameter). A cross-sectional area of a hollow of the tubular member 37 is larger than a cross-sectional area of a hollow of the ink inlet hollow needle 36. The part of the ink inlet hollow needle 36 extending below the top plate 31 into the main body 30 is inserted in the tubular member 37 and thus the inside of the tubular member 37 is in communication with the ink inlet hollow needle 36. The tubular member 37 extends downward farther than the ink inlet hollow needle 36 and the tubular member 39 do.

The hollow needle-like ink inlet hollow needle 36 and air outlet hollow needle 38 extend through the plug members 24 of the ink cartridge 3, respectively. Where the ink cartridge 3 is disposed above the buffer tank 4, the air flows out into the ink cartridge 3 through the opening 38*a* of the air outlet hollow needle 38 of the air outlet passage 35. In place of the discharged air, the ink I in the ink cartridge 3 flows into the buffer tank 4 through the opening 36*a* of the ink inlet hollow needle 36 of the ink inlet passage 34. When the ink level of the buffer tank 4 is raised to a level close to the lower end of the tubular member 39 constituting the air outlet passage 35, the ink I is drawn into the tubular member 39, not allowing the air to flow out into the ink cartridge 3 through the tubular member 39, and thus the ink I is no more drawn into the buffer tank 4.

In the state where the ink I is not ejected from the nozzle 2*a* and the ink I in the buffer tank 4 does not flow toward the nozzle 2*a*, the ink level of the buffer tank 4 is held close to the level corresponding to the lower end of the tubular member 39. As shown in FIG. 2, a distance $h_1$ between the lower end of the tubular member 39 and the lower end of the air outlet hollow needle 38 is set at a value larger than a head difference $h_0$ (see FIG. 8) necessary to break a meniscus formed at the lower end of the air outlet hollow needle 38 due to the surface tension of the ink I.

For instance, where the surface tension of the ink I is 40 mN/m and the inner diameter of the air outlet hollow needle 38 is 1.4 mm, the head difference $h_0$ is 9 mm; in this case, according to the present embodiment, the distance $h_1$ between the lower end of the tubular member 39 and the air outlet hollow needle 38 is made larger than the value of the head difference $h_0$ (9 mm), namely, 13 mm.

Thus, even when the ink I is ejected from the nozzle 2*a* with the ink I in the buffer tank 4 flowing out toward the nozzle 2*a* to lower the ink level of the buffer tank 4, the distance between the lower end of the air outlet hollow needle 38 and the surface of the ink I is held larger than the value of the head difference $h_0$, and thereby there is not formed a meniscus at the lower end of the air outlet hollow needle 38 of the relatively small diameter, but when the ink level is lowered to be separated from the lower end of the tubular member 39, a meniscus is formed at the lower end of the tubular member 39 due to the surface tension of the ink I. More specifically, a meniscus is initially formed with respect to the outer circumference of the lower end of the tubular member 39, and then with respect to the inner circumference of the lower end of the tubular member 39. That is to say, a meniscus is formed around the lower end of the tubular member 39, namely, at the lower side of an outer periphery of the lower end of the tubular member 39, when the ink level is lowered to a level slightly below the lower end of the tubular member 39 as the ink I in the buffer tank is consumed; when the ink level is further lowered to a level to make the lower end of the tubular member 39 completely off the ink surface, i.e. the meniscus formed at the lower side of the outer periphery of the lower end of the tubular member 39 is broken, there now emerges an upwardly convex meniscus inside the lower end of the tubular member 39.

Figure 8:
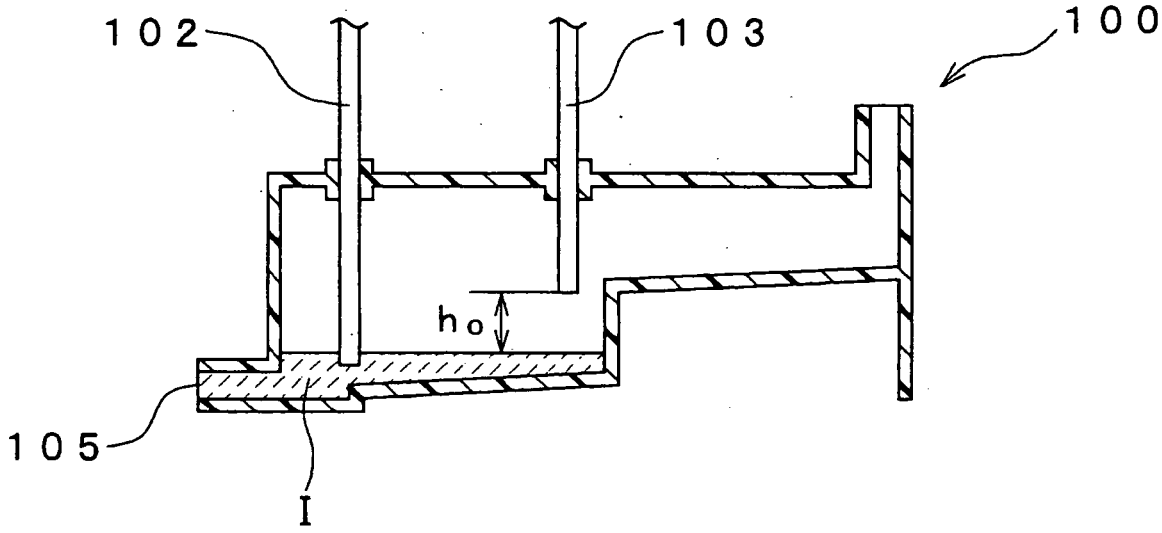
FIG. 8 is a cross sectional view of the conventional buffer tank.

In this regard, the inner diameter of the tubular member 39 is larger (e.g. more than three times larger) than that of the air outlet hollow needle 38, and therefore the head difference necessary to break the meniscus (i.e. the distance between the lower end of the tubular member 39 and the ink surface) is significantly decreased, compared to the case where the meniscus is formed at the lower end of the air outlet hollow needle 38 as in the conventional buffer tank shown in FIG. 8. Thus, even by a slight lowering in the ink level, the meniscus inside the lower end of the tubular member 39 (or the ink inside the tubular member 39) is pulled toward the ink cartridge under the negative pressure in the ink cartridge, and thereby the meniscus inside the lower end of the tubular member 39 is broken. As a result, the air in the buffer tank 4 flows out into the air outlet hollow needle 38.

Further, the lower end of the tubular member 39 has the local protrusion 39*a* projecting downward and it is thereby arranged such that the lower end has the part a distance between which and the ink surface is differentiated from a distance between the other part and the ink surface. Hence, when the ink level is lowered, the balance of the surface tension acting on the meniscus formed around or inside the lower end of the tubular member 39 is easily disrupted around the protrusion 39*a*, and thereby the break of the meniscus is made easier. In addition, when the meniscus is broken, the ink I inside the tubular member 39 is drawn downward by the surface tension of the ink I along the protrusion 39*a*, and on the other hand, the air flows into the tubular member 39 from the left side part, as seen in FIG. 2, of the lower end of the tubular member 39. Hence, the ink I inside the tubular member 39 and the air are instantaneously replaced with each other. Thus, when the ink level is lowered, the air is immediately allowed to flow out into the ink cartridge 3.

On the other hand, the part of the ink inlet hollow needle 36 extending inside the main body 30 or below the top plate 31 is inserted in the tubular member 37 having a diameter larger than that of the ink inlet hollow needle 36 and extending downward farther than the ink inlet hollow needle 36 does. Thus, the ink I, which is drawn into the buffer tank 4 from the ink cartridge 3 via the ink inlet passage 34, flows through the tubular member 37 of the relatively large diameter in the buffer tank 4, significantly reducing the resistance of the ink draft passage 34 to the flow of the ink I. Therefore, as the air in the buffer tank 4 flows out into the ink cartridge 3, the ink I in the ink cartridge 3 is drawn into the buffer tank 4, immediately replenishing the buffer tank 4 with the ink I.

According to the ink jet printer 1 described above, there are obtained the following effects. Since the tubular member 39 having a larger diameter than that of the air outlet hollow needle 38 and in communication with the air outlet hollow needle 38 is disposed to extend through the top plate 31 of the buffer tank 4, such that the tubular member 39 extends downward farther than the air outlet hollow needle 38 does. Hence, when the ink level is lowered, a meniscus is not formed at the lower end of the air outlet hollow needle 38 having the relatively small diameter, but is formed at the lower end of the tubular member 39 of the relatively large diameter; the meniscus formed at the lower end of the tubular member 39 of the relatively large diameter is more easily broken than a meniscus formed at the lower end of the air outlet hollow needle 38 of a relatively small diameter. By this arrangement, the variation in the ink level of the buffer tank can be reduced, with the variation in the back pressure applied to the nozzle 2*a* being suppressed, in comparison with the conventionally obtained buffer tank.

Further, since the lower end of the tubular member 39 has the local downward protrusion 39*a*, the balance of the surface tension at the meniscus is easily disrupted, making the break of the meniscus easier. Therefore, when the ink level is slightly lowered, the meniscus formed around or inside the lower end of the tubular member 39 is immediately broken, instantaneously flowing the air out into the ink cartridge 3 via the air outlet passage 35.

The top plate 31 of the buffer tank 4 is also provided with the tubular member 38 having a diameter larger than that of the ink inlet hollow needle 36 and in communication with the ink inlet hollow needle 36. The tubular member 37 extends downward farther than the ink inlet hollow needle 36 does. Thus, the ink I drawn into the buffer tank 4 from the ink cartridge 3 flows through the tubular member 37 of the relatively large diameter in the buffer tank 4, reducing the resistance of the ink inlet passage 34 to the flow of the ink I. Therefore, when the air in the buffer tank 4 flows out into the ink cartridge 3 via the air outlet passage 35, the ink I is immediately drawn into the buffer tank 4 through the ink inlet passage 34 to replenish the buffer tank 4. Thus, the variation in the ink level of the buffer tank 4 is suppressed, with reduction in the variation in the back pressure of the ink I applied on the nozzle 2*a*.

According to this invention, the lower ends of the ink inlet hollow needle 36 and the air outlet hollow needle 38 need not be differentiated in level, but may be located at the same level. Therefore, the ink inlet hollow needle 36 and the air outlet hollow needle 38 can be constituted by an identical member of a hollow needle-like shape, lowering the required cost of components.

Since the top plate 31 and the tubular members 37, 39 are integrally formed of a synthetic resin, the number of components and steps in the assembly process can be both reduced, lowering the manufacturing cost. It is noted that even where only one of the tubular members 37, 39 is formed integrally with the top plate 31, the same advantage can be enjoyed.

There will be now described various modifications of the above-described embodiment. Elements having the same structure as the corresponding elements in the above embodiment will be referred to by the same reference numerals and description thereof will be omitted, if appropriate.

Figure 4:
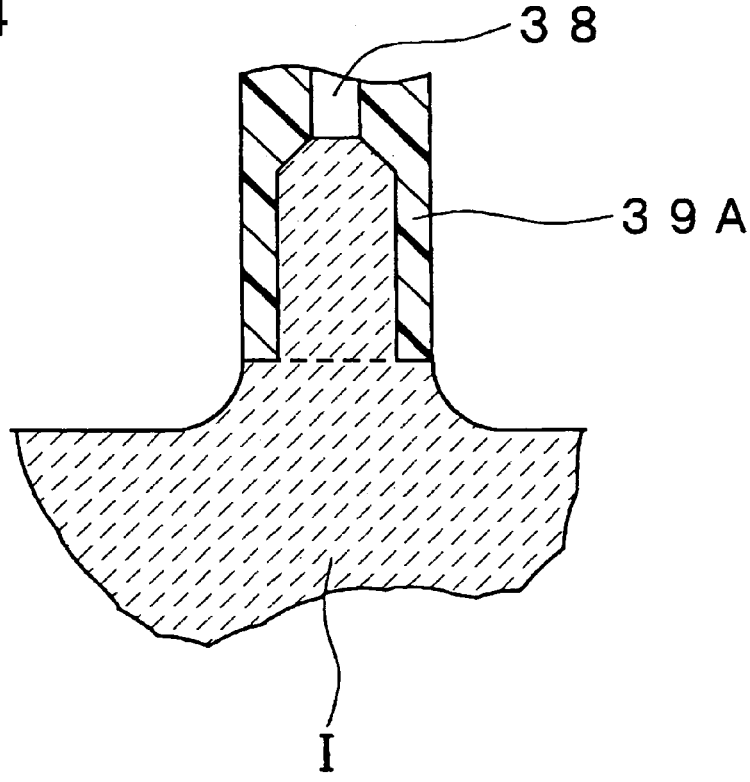
FIG. 4 is a view corresponding to FIG. 3, according to a second embodiment.

(1) The shape of the lower end of the tubular member 39 in communication with the air outlet hollow needle 38 is preferably, but not necessarily limited to, that as described above and shown in FIG. 3. For instance, as shown in FIG. 4, a lower end surface of the tubular member 39A may be parallel to the ink surface. In this case, the balance of the surface tension at the meniscus is made difficult to be broken and the degree of lowering in the ink level required to break the meniscus is increased, as compared to the arrangement shown in FIG. 3. However, as compared to the conventional arrangement as shown in FIG. 8, where the meniscus is formed at the lower end of the air outlet hollow needle 38 of the relatively small diameter, the arrangement of FIG. 4 significantly facilitates breaking the meniscus. In addition, the process of forming the tubular member 39A is made very easy.

Figure 5:
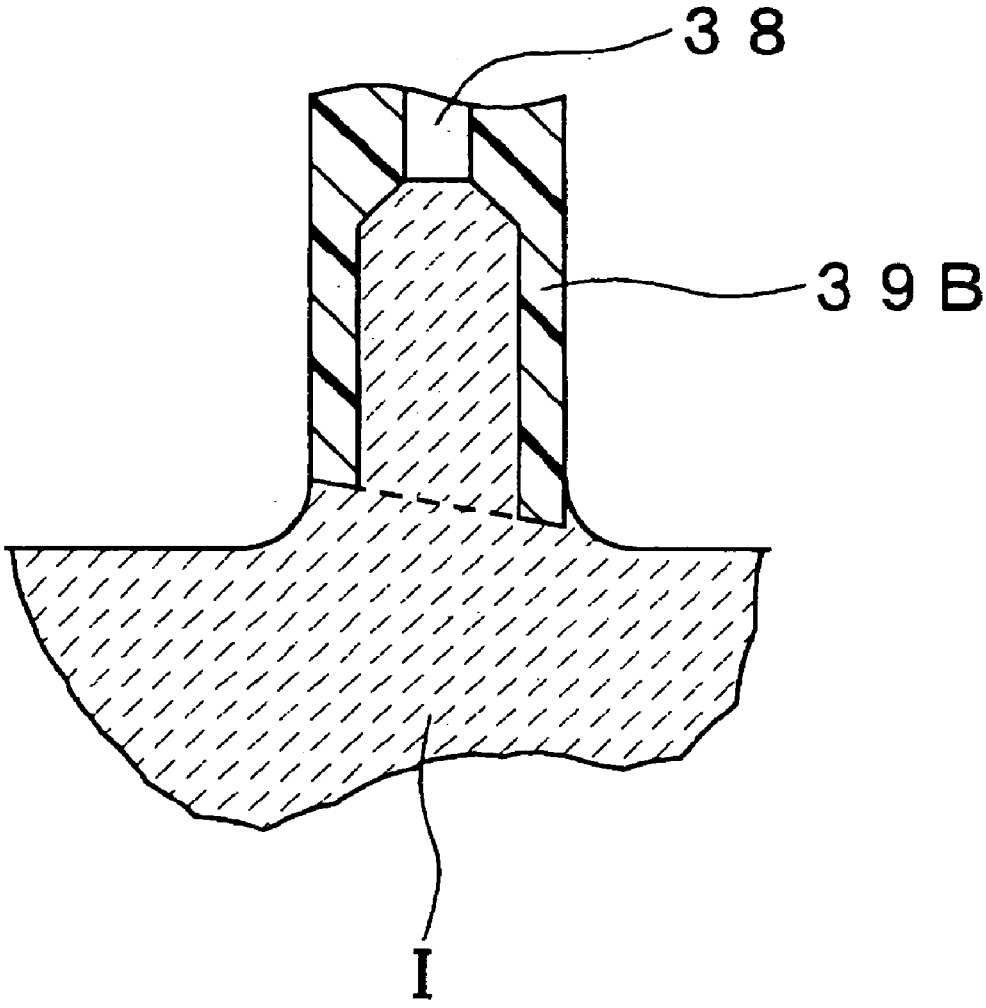
FIG. 5 is a view corresponding to FIG. 3, according to a third embodiment.

Nonetheless, an arrangement where the lower end of the tubular member 39 has a local part where a distance from the ink surface is different from a distance between the other part and the ink surface, further facilitating the disruption of the balance of the surface tension acting on the lower end of the tubular member, which makes the break of the meniscus easier than in the conventional arrangement shown in FIG. 8. For instance, as shown in FIG. 5, a lower end surface of the tubular member 39B is inclined with respect to the ink surface by a certain degree, so that the balance of the surface tension of the meniscus is easily disrupted, making it easy to break the meniscus. In this regard, the degree by which the lower end surface of the tubular member 39B is inclined with respect to the ink surface is preferably about 10° to about 20°.

(2) It is not essential to integrally form the top plate 31 and the tubular members 37, 39 of a synthetic resin; the top plate 31 and the tubular members 37, 39 may be separately formed from one another.

Figure 6:
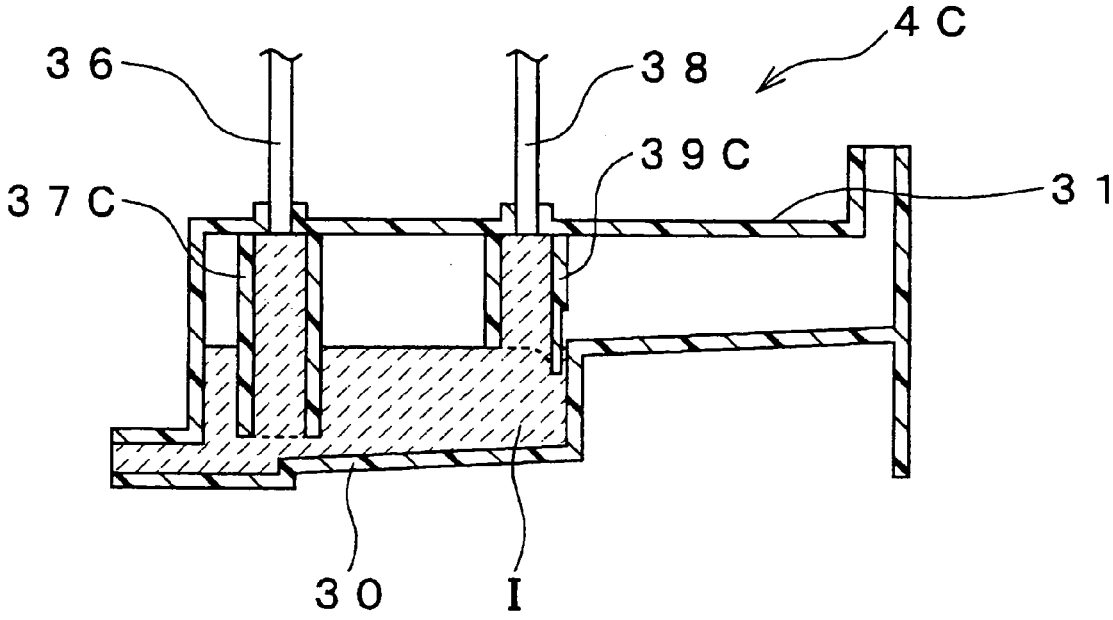
FIG. 6 is a view corresponding to FIG. 2, according to a fourth embodiment.
Figure 7:
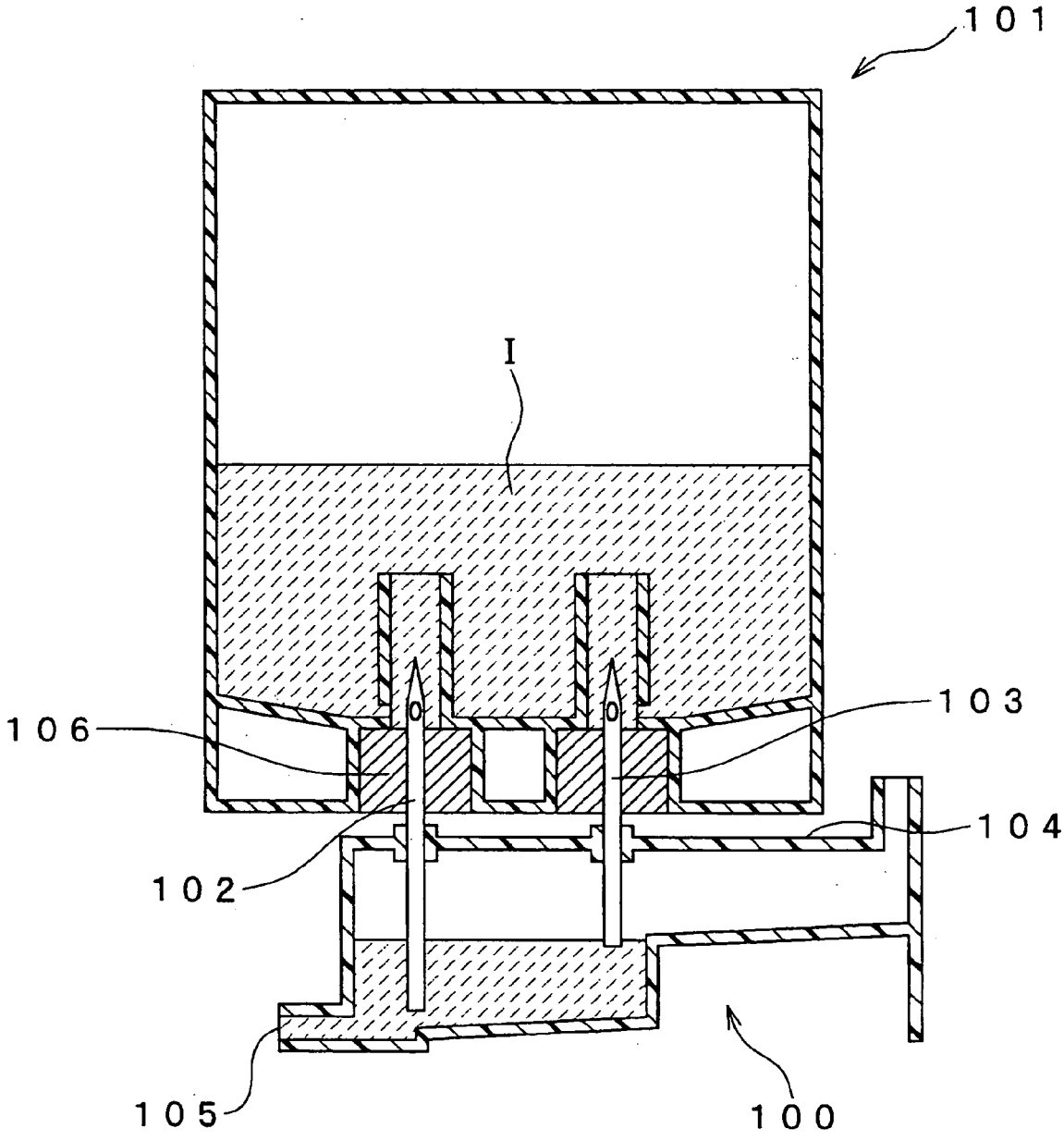
FIG. 7 is a cross sectional view of a conventional ink cartridge and buffer tank.

(3) In the above-described embodiment, the ink inlet hollow needle 36 and the air outlet hollow needle 38 respectively extend through the top plate 31. However, in a modification as shown in FIG. 6, an ink inlet and air outlet hollow needles 36, 38 respectively extend merely upward from, and not below, a top plate 31 of a buffer tank 4C, and are in communication with tubular members 37C, 39C, respectively. In this case, the distance between the lower end of the air outlet hollow needle 38 and the ink surface can be further increased. In addition, the resistance of the ink inlet passage 34 to the flow of the ink I when flowing into the buffer tank 4C can be further reduced, since the ink I flows only through the tubular member 37C of the relatively large diameter in the buffer tank 4C.

(4) It is sufficient that the tubular member 39 in which the air outlet hollow needle 38 is inserted has, at least at its lower end, a diameter larger than that of the air outlet hollow needle 38. Therefore, the tubular member 39 may be formed in a shape having a diameter which increases toward its lower end, in other words, a trumpet-like shape.

(5) Although in the above-described embodiment, the tubular members 37, 39 are formed in a cylindrical shape, the tubular members 37, 39 may have other shapes, for instance, a prism which is polygonal in cross section. In other words, as long as the cross-sectional area of at least the lower end part of the hollow of the tubular member 37 is larger than that of the hollow part of the ink inlet hollow needle 36, the shape of the cross section of the tubular member 37 may be arbitrarily changed to reduce the resistance of the ink inlet passage 34 to the flow of the ink I drawn into the buffer tank 4, as compared to the conventional arrangement. Further, as long as the cross-sectional area of at least the lower end part of the hollow of the tubular member 39 is larger than that of the hollow part of the air outlet hollow needle 38, the shape of the cross section of the tubular member 39 may be arbitrarily changed to make it easier to break the meniscus in comparison to the conventional arrangement.

What is claimed is:

1. A buffer tank for an ink jet printer, on whose upper side is attached an ink cartridge containing an ink which is drawn into the buffer tank, the buffer tank comprising:

a main body having a top plate;

an air intake through which air outside the buffer tank is taken into the buffer tank;

an air outlet passage which comprises at least a part extending in the main body downward from the top plate, so as to flow the air in the buffer tank out into the ink cartridge; and an ink inlet passage which comprises at least a part extending in the main body downward from the top plate, so as to draw the ink in the ink cartridge into the buffer tank, wherein each of the air outlet passage and the ink inlet passage comprises a hollow needle disposed at the top plate and vertically extends, and the air outlet passage comprises a hollow tubular member which is configured so as to extend down from the top plate to a level below a lower end of the hollow needle of the air outlet passage and above a lower end of the ink inlet passage, with an inner space of the hollow tubular member being in communication with an inner space of the hollow needle of the air outlet passage, and a cross-sectional area of a hollow of the tubular member at least at a lower end thereof being larger than a cross-sectional area of a hollow of the hollow needle of the air outlet passage.

2. The buffer tank according to claim 1, wherein the lower end of the tubular member has a part a distance between which and a surface of the ink in the buffer tank is different from a distance between the other part of the lower end and the surface of the ink.

3. The buffer tank according to claim 2, wherein the lower end of the tubular member is configured such that a lower end surface of the tubular member is inclined by an angle with respect to the surface of the ink in the buffer tank.

4. The buffer tank according to claim 2, wherein a circumference of the lower end of the tubular member has a local downward projection.

5. The buffer tank according to claim 1, wherein the tubular member has a cylindrical shape.

6. The buffer tank according to claim 1, wherein the tubular member is configured such that an inner diameter of the tubular member is increased toward its lower end.

7. The buffer tank according to claim 1, wherein the hollow needle vertically extend through the top plate, and a part of the hollow needle extending below the top plate, in the main body of the buffer tank, is inserted in the tubular member.

8. The buffer tank according to claim 1, wherein the hollow needle of the air outlet passage extends from the top plate only upward.

9. The buffer tank according to claim 1, wherein the top plate and the tubular member are integral.

10. The buffer tank according to claim 9, wherein the top plate and tubular member are formed of a synthetic resin.

11. The buffer tank according to claim 1, wherein the ink inlet passage comprises a hollow tubular member which is configured so as to extend down from the top plate to a level below a lower end of the hollow needle of the ink inlet passage and a lower end of the air outlet passage, with an inner space of the hollow tubular member of the ink inlet passage being in communication with an inner space of the hollow needle of the ink inlet passage, and a cross-sectional area of a hollow of the tubular member of the ink inlet passage being larger than a cross-sectional area of a hollow of the hollow needle of the ink inlet passage.

12. The buffer tank according to claim 11, wherein the hollow needle of the ink inlet passage vertically extends through the top plate, and a part of the hollow needle of the ink inlet passage extending below the top plate, in the main body of the buffer tank, is inserted in the tubular member of the ink inlet passage.

13. The buffer tank according to claim 11, wherein the hollow needle of the ink inlet passage extends from the top plate only upward.

14. The buffer tank according to claim 11, wherein the top plate and the tubular member are integral.

15. The buffer tank according to claim 14 wherein the top plate and tubular member are formed of a synthetic resin.

16. The buffer tank according to claim 11, wherein the hollow needles are respectively constituted by an identical needle member.

17. An ink jet printer comprising:

a buffer tank according to claim 1; and a print head which ejects the ink supplied from the buffer tank.

18. The printer according to claim 17, wherein the lower end of the tubular member has a part a distance between which and a surface of the ink in the buffer tank is different from a distance between the other part of the lower end and the surface of the ink.

19. The printer according to claim 17, wherein the hollow needle of the air outlet passage vertically extends through the top plate, and a part of the hollow needle of the air outlet passage extending below the top plate, in the main body of the buffer tank, is inserted in the tubular member of the air outlet passage.

20. The printer according to claim 17, wherein the ink inlet passage comprises a hollow tubular member which is configured so as to extend down from the 'top plate to a level below a lower end of the hollow needle of the ink inlet passage and a lower end of the air outlet passage, and whose inner space is in communication with an inner space of the hollow needle of the ink inlet passage, with a cross-sectional area of a hollow of the tubular member of the ink inlet passage being larger than a cross-sectional area of a hollow of the hollow needle of the ink inlet passage.

* * * * *